US009402427B2

(12) United States Patent
Adafin et al.

(10) Patent No.: US 9,402,427 B2
(45) Date of Patent: Aug. 2, 2016

(54) SELF-CONTAINED THERMAL DISTRIBUTION AND REGULATION DEVICE FOR COLD WEATHER APPAREL

(75) Inventors: Toni V. Adafin, Rochester, MN (US); Perry A. Bakken, Rochester, MN (US); Michael A. Jones, West Concord, MN (US); John H. Mohlke, Pine Island, MN (US); Joel A. Gotelaere, Rochester, MN (US); Jeffrey E. Thompson, Chatfield, MN (US); Charles H. Luong, Rochester, MN (US); Carl C. Voss, Eyota, MN (US)

(73) Assignee: International Business Machines Corporation, Armonk, NY (US)

( * ) Notice: Subject to any disclaimer, the term of this patent is extended or adjusted under 35 U.S.C. 154(b) by 632 days.

(21) Appl. No.: 13/612,405

(22) Filed: Sep. 12, 2012

(65) Prior Publication Data

US 2014/0069410 A1 Mar. 13, 2014

(51) Int. Cl.
*A41D 13/005* (2006.01)

(52) U.S. Cl.
CPC ..... *A41D 13/0051* (2013.01)

(58) Field of Classification Search
CPC .. A41D 13/0051; A41D 13/0058; A61F 7/02; A61F 2001/001; B63C 11/28
USPC ..... 216/204, 205, 207, 208; 431/146; 32/2.6
See application file for complete search history.

(56) References Cited

U.S. PATENT DOCUMENTS

| | | | | |
|---|---|---|---|---|
| 382,681 | A * | 5/1888 | Batter | 36/2.6 |
| 2,715,400 | A * | 8/1955 | Butler | 126/208 |
| 3,866,596 | A * | 2/1975 | Gottwald et al. | 126/208 |
| 5,269,369 | A | 12/1993 | Faghri | |
| 6,138,664 | A * | 10/2000 | Hanada et al. | 126/208 |
| 6,550,471 | B2 * | 4/2003 | Szymocha et al. | 126/208 |
| 7,347,831 | B2 * | 3/2008 | Chiu | 601/15 |
| 2007/0154700 | A1 | 7/2007 | Touzov | |
| 2007/0161306 | A1 | 7/2007 | Magill et al. | |
| 2008/0099188 | A1 | 5/2008 | Touzov | |
| 2008/0163861 | A1 * | 7/2008 | Chen | 126/208 |
| 2008/0176292 | A1 * | 7/2008 | Ugaz et al. | 435/91.2 |
| 2010/0107657 | A1 | 5/2010 | Vistakula | |
| 2010/0227286 | A1 | 9/2010 | Hockaday et al. | |
| 2011/0049117 | A1 * | 3/2011 | Macher et al. | 219/211 |
| 2011/0313497 | A1 | 12/2011 | McFarlane | |

FOREIGN PATENT DOCUMENTS

| | | |
|---|---|---|
| JP | 2011-162931 | 8/2011 |
| WO | 2005055751 A1 | 6/2005 |

* cited by examiner

*Primary Examiner* — Steven B McAllister
*Assistant Examiner* — Steven Anderson, II
(74) *Attorney, Agent, or Firm* — Damion Josephs

(57) ABSTRACT

A thermal distribution and regulation system for a garment that includes a self-contained heat source, such as a catalytic heat source. A heat manifold extends about a surface of the heat source and is mechanically adjusted relative to the surface of the heat source to control the contact surface area between the heat source and heat manifold to regulate heat conducted from the heat source. The heat manifold is configured to engage the surface of the heat source at more than one predetermined location to prevent inadvertent movement between the heat source and heat manifold. The system also includes a plurality of heat conductors coupled to the heat manifold and affixed to the garment. An end of each heat conductor is coupled to the heat manifold for conducting heat from the heat manifold to the garment to warm the garment.

15 Claims, 2 Drawing Sheets

SELF-CONTAINED THERMAL DISTRIBUTION AND REGULATION DEVICE FOR COLD WEATHER APPAREL

BACKGROUND

The present invention relates generally to clothing for thermal regulation of the human body, and more particularly, to a self-contained thermal distribution and regulation device for cold weather apparel.

The need to maintain body temperature exists where human activities are conducted in extreme temperature environments. Very cold environments are often encountered by individuals who pursue outdoor winter activities such as snowmobilers, motorcycle riders, hunters, snow skiers, and workers, such as construction and highway workers, who work outside during the winter. Also, individuals who work in more pedestrian cold environments, such as refrigerated containers are exposed to extreme cold temperatures.

The most prevalent method today for individuals who are exposed to extreme cold temperatures or pursue outdoor winter activities to maintain their body temperature is to wear several layers of clothing, commonly referred to as "layered clothing" or "layering". Wearing several layers of clothing on top of each other, lowers heat losses to match the body's internal heat production and protect from environmental elements. Some of the layers have different, largely non-overlapping, functions. Using more or fewer layers, or replacing one layer but not others, allows for flexible clothing to match the needs of each situation. For example, two thin layers can be warmer yet lighter than one thick layer, because the air trapped between layers serves as "thermal insulation".

Layering typically consists of about three layers of clothing that are identified as the inner or base layer, the mid or insulating layer, and the shell or outer layer. The base layer is typically against the wearer's skin to manage moisture and keep the wearer's skin dry. The outer layer protects the wearer from environmental conditions such as wind, rain, and snow and also serves as protection over the base and insulating layers. The insulating layer provides warmth to the wearer and may be considered the most important layer worn.

The insulating layer is what keeps the wearer warm while they participate in activities in the cold. Materials used for the insulating layer vary widely; from materials used for over a century, such as wool and down, to cutting edge fleece and polypropylene and polyester materials. Additionally, the insulating layer is thick as compared to the other layers, to reduce conductive heat loss. However, heat flow is an inevitable consequence of contact between objects of differing temperature, and thus over time the wearer's clothing may not sufficiently match their body's internal heat production and they may get cold.

An effort to improve the insulating layer's ability to lower heat losses to match the body's internal heat production is realized in so-called "heated clothing" or "heated thermal clothing". In one example, an item of heated clothing such as a vest or jacket, may comprise two layers of a synthetic material, such as a synthetic fleece, with a heating layer sandwiched between the two fleece layers. Alternatively, an item of heated clothing may comprise a soft inner or base layer, with an outer layer for protection from environmental elements, with the heating layer sandwich between the two layers.

In heated clothing, the heating layer typically comprises a heat element system connected to a heat source. There are several heating technologies employed for the heat element system including copper wire, nichrome wire, metal "mesh", carbon-embedded fabric, and carbon fibers.

An electrical heat source is connected to the heat element system, for powering system. For example in heated clothing designed for use on vehicles such as motorcycles and snowmobiles, a 12 volt electrical connector for connecting the heated garment to the vehicle's battery is used. Some heated garments are provided with a well-known cigarette lighter plug, so that the garment can be plugged into the vehicle's cigarette lighter receptacle. A disadvantage of this type of heated clothing is that the wearer must be in close proximity to an external electrical power source.

For electrically powered heated clothing designed for use where no external power source is available, batteries, including rechargeable batteries, are used to power the heat source. A disadvantage of batteries, both rechargeable and non-rechargeable, is they have a very limited life span, typically only hours before the batteries must be either replaced with new batteries or recharged. A disadvantage of rechargeable batteries, such as nickel metal hydride or lithium batteries, is that their "battery memory" diminishes over time and reduces the battery's capability to recharge further reducing the useful hours of the battery. Also, there are health concerns about the electrical currents of electrically powered heated traveling in close proximity to the wearer's body and what effects those electrical currents may have on the wearer's body.

BRIEF SUMMARY

In one embodiment, a thermal distribution and regulation device for a garment that includes a self-contained heat source and a heat manifold contacting a surface of the heat source. The heat manifold is mechanically adjusted relative to the heat source to control the contact surface area between the heat source and heat manifold for regulating heat conducted from the heat source. The device also includes a heat conductor in thermal communication with the heat manifold. The heat conductor conducts heat from the heat manifold along the garment.

In another embodiment a thermal distribution and regulation system for a garment that includes a self-contained heat source and a heat manifold extending about a surface of the heat source and engaging the surface. The heat manifold is mechanically adjusted relative to the heat source to control the contact surface area between the heat source and heat manifold for regulating heat conducted from the heat source. The system also includes more than one heat conductor in thermo-mechanical communication with the heat manifold and extending along the garment for warming the garment.

In another embodiment, a thermal distribution and regulation system for a garment that comprises a self-contained heat source comprising one of a chemical, liquid, and catalytic heat source. A heat manifold extends about a surface of the heat source. The heat manifold is mechanically adjusted relative to the surface of the heat source to control the contact surface area between the heat source and heat manifold to regulate heat conducted from the heat source. The heat manifold configured to engage the surface of the heat source at more than one predetermined location to prevent inadvertent movement between the heat source and heat manifold to control heat conducted from the heat source to the heat manifold. The system also includes a plurality of heat conductors coupled to the heat manifold and affixed to the garment. An end of each of the plurality of heat conductors is coupled to the heat manifold for conducting heat from the heat manifold to the garment, to warm the garment.

DETAILED DESCRIPTION

The following description is made for the purpose of illustrating the general principles of the invention and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

In one embodiment, a thermal distribution and regulation device for a garment that includes a self-contained heat source and a heat manifold contacting a surface of the heat source. The heat manifold is mechanically adjusted relative to the heat source to control the contact surface area between the heat source and heat manifold for regulating heat conducted from the heat source. The device also includes a heat conductor in thermal communication with the heat manifold. The heat conductor conducts heat from the heat manifold along the garment.

In another embodiment a thermal distribution and regulation system for a garment that includes a self-contained heat source and a heat manifold extending about a surface of the heat source and engaging the surface. The heat manifold is mechanically adjusted relative to the heat source to control the contact surface area between the heat source and heat manifold for regulating heat conducted from the heat source. The system also includes more than one heat conductor in thermo-mechanical communication with the heat manifold and extending along the garment for warming the garment.

In another embodiment, a thermal distribution and regulation system for a garment that comprises a self-contained heat source comprising one of a chemical, liquid, and catalytic heat source. A heat manifold extends about a surface of the heat source. The heat manifold is mechanically adjusted relative to the surface of the heat source to control the contact surface area between the heat source and heat manifold to regulate heat conducted from the heat source. The heat manifold configured to engage the surface of the heat source at more than one predetermined location to prevent inadvertent movement between the heat source and heat manifold to control heat conducted from the heat source to the heat manifold. The system also includes a plurality of heat conductors coupled to the heat manifold and affixed to the garment. An end of each of the plurality of heat conductors is coupled to the heat manifold for conducting heat from the heat manifold to the garment, to warm the garment.

Figure 1:
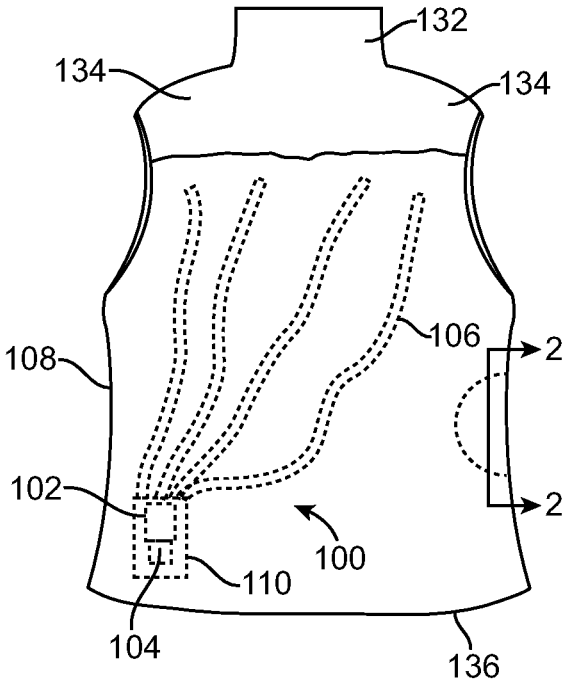
FIG. 1 is a simplified diagram showing an exemplary embodiment, partially in phantom, of a thermal distribution and regulation system for a garment.

Referring now to FIG. 1 there is shown, generally at 100, an exemplary embodiment of a thermal distribution and regulation system for a garment. In the embodiment, shown, the thermal distribution and regulation system comprises a heat manifold 102 coupled to a heat source 104. A plurality of heat conductors 106 are coupled to the heat manifold 102 and affixed to a garment 108.

Figure 2:
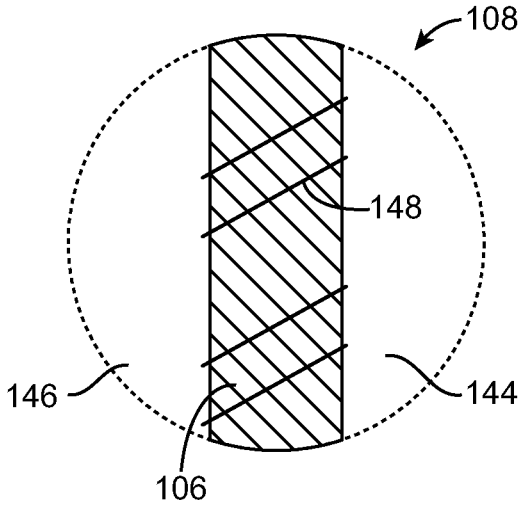
FIG. 2 is a fragmentary cross-sectional view taken along lines 2-2 of FIG. 1 showing a heat conductor of the exemplary embodiment of the thermal distribution and regulation system for a garment secured to a garment.

As shown in FIG. 1 and FIG. 2, the garment 108 comprises a vest. However it is to be understood that the garment 108 may be any desired or suitable article of clothing. For example, the garment 108 may comprise a jacket, shirt, or insulated shirt. Typically, but not necessarily, the garment 108 comprises an article of clothing that is worn over the torso and that may be used as an insulating layer, such as a vest or jacket. Alternatively, the garment 108 may comprise an article of clothing that is worn over the hands such as gloves or mittens.

Figure 3:
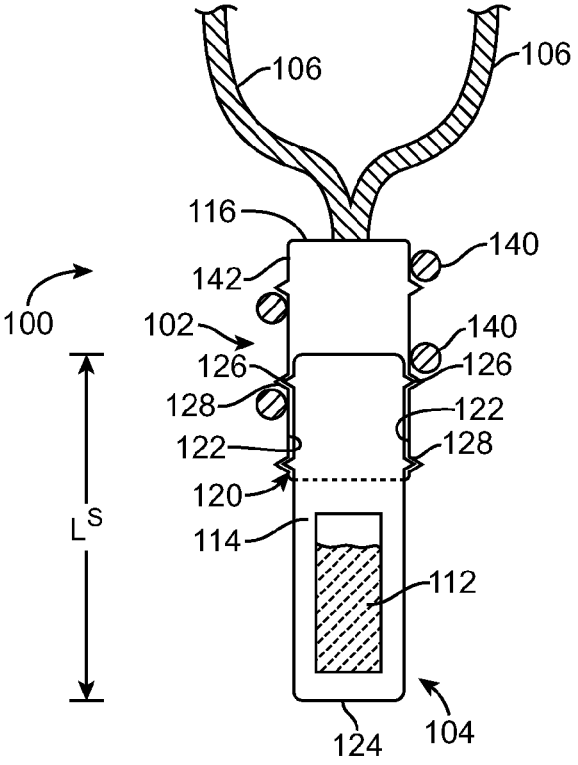
FIG. 3 is a simplified fragmentary, partially cut-away diagram showing an exemplary embodiment of a heat manifold contacting a surface of a heat source of a thermal distribution and regulation system for a garment.
Figure 4:
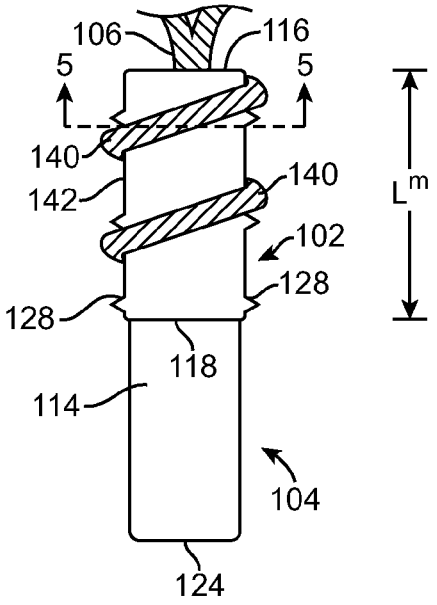
FIG. 4 is a simplified fragmentary, diagram showing an exemplary embodiment of a heat manifold contacting a surface of a heat source of a thermal distribution and regulation system for a garment.
Figure 5:
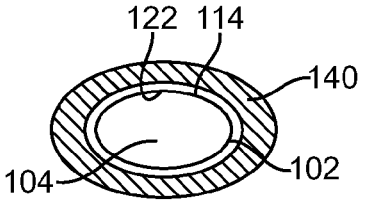
FIG. 5 is a cross-sectional view taken along lines 5-5 of FIG. 4 showing an exemplary embodiment of a heat conductor coupled to a heat manifold in contact with a surface of a heat source.

Referring to FIGS. 3-5, in the exemplary embodiment shown, the heat source 104 of the system 100 may optionally comprise any one of a chemical, liquid, and catalytic heat source known in the art. In the exemplary embodiment, the heat source 104 comprises a commercially available catalytic heat source, or heater, that is designed to fit in a pocket of a user's clothing or to be held in their hand. As shown in FIG. 1, the garment 108 includes a pocket 110 dimensioned to retain the heat source 104 and at least a portion of the heat manifold 102, while allowing a user to access the manifold 102 and heat source 104. The heat source 104 uses a commercially available replenishable fuel 112 to facilitate the catalytic burning process that generates heat. The fuel 112, may comprise naphtha, butane, or any suitable fuel.

In one embodiment, the heat manifold 102 is configured to extend about an outer surface 114 of the heat source 104. In one exemplary embodiment, the heat manifold 102 includes a top end 116 and a bottom edge 118 that forms an aperture 120 configured to receive the heat source 104. In an embodiment of the invention, the heat manifold 102 is formed complementary to the outer surface 114 of the heat source 104 for efficient heat transfer from the heat source 104 to the manifold 102.

As shown in FIG. 5, in one embodiment, the heat source 104 has an annular cross-sectional configuration. Accordingly, the head manifold 102 is formed with an annular cross-sectional configuration, so that an inner surface 122 of the manifold 102 extends about the outer surface 114 of the heat source 104 an in close proximity thereto. In one embodiment, the heat manifold 102 is dimensioned with a length $L^M$ that is approximately equal to or less than a length $L^S$ of the heat source 104. Configuring the heat manifold 102 with a length $L^M$ that is approximately equal to or less than the length $L^S$ of the heat source 104 allows the heat manifold 102 to substantially enclose the heat source 104 when the manifold's bottom edge 118 is aligned with or proximate to a bottom 124 of the heat source 104. When the heat manifold's bottom edge 118 is aligned with or proximate to the bottom 124 of the heat source 104, heat transfer from the heat source 104 to the heat manifold 102 is maximized.

Continuing with FIGS. 3-5, the heat manifold 102 is mechanically adjusted relative to the outer surface 114 of the heat source 104 to control the contact surface area between the heat source 104 and heat manifold 102 to regulate heat conducted from the heat source 104 to the manifold 102. Thus, adjusting the heat manifold 102 along the heat source's length $L^S$ functions as a mechanical thermostat for regulating the heat conducted from the heat source 104 to the manifold 102 and on to the garment 108.

To provide a user with a substantially precise means of controlling the heat conducted from the heat source 104 to the garment 108, in one embodiment the outer surface 114 of the heat source 104 is configured with protuberances 126 configured to engage detents 128 in the heat manifold 102. In one preferred embodiment, the protuberances 126 are spatially positioned about the heat source's outer surface 114, while detents 128 are spatially positioned about the heat manifold's inner surface 122 and along its length $L^M$. A user inserts the heat source 104 into the heat manifold 102 at different depths to control the contact surface area between the heat source 104 and heat manifold 102 for regulating the heat conducted from the heat source 104 to the manifold 102, along the heat conductors 106 and on to the garment 108.

As shown in FIG. 3 and FIG. 4, the heat source 104 is inserted into the heat manifold 102 until its protuberances 126 reside in a second row of the heat manifold's detents 128. In this position, approximately half of the heat source 104 resides within the heat manifold 102 and approximately half of the heat output from the heat source 104 is conducted to the heat manifold 102. With the heat source's protuberances 126 residing in the heat manifold's detents 128, the heat source 104 is coupled to the manifold 102. The protuberances 126 engage the detents 128 to prevent inadvertent movement between the heat source 104 and heat manifold 102 and to provide the user with a substantially precise means of controlling the heat conducted from the heat source 104 to the manifold 102.

Referring to the drawing Figures, in one embodiment of the invention, the system 100 includes heat conductors 106 that are coupled to the heat manifold 102 and affixed to the garment 108. While four heat conductors 106 are shown in FIG. 1, this is for ease of discussion only. It is to be understood that there may be any suitable number of heat conductors 106 as needed to provide heat to the garment 108 from the heat source 104. There may be as few as a single heat conductor 106 to as many heat conductors 106 as desired.

In the exemplary embodiment shown, the heat conductors 106 are shown traveling generally vertically, from the heat source 104 towards a neck 132 and shoulder area 134 of the garment 108. It is to be understood that the heat source 104 may be positioned on and/or secured to the garment 108 at any suitable location. Thus, if the heat source 104 is positioned near the neck 132 and shoulder area 134 of the garment 108, the heat conductors 106 may travel generally vertically down from the heat source 104 towards a waist 136 of the garment 108. Alternatively the heat conductors 106 may travel generally transversely across the garment 108, between the shoulder area 134 and waist 136. Additionally, while the heat conductors 106 are shown traveling generally vertically across the garment 108, it is to be understood that they may be secured to the garment 108 in any suitable pattern and/or any pattern which may provide heat transfer from the heat conductors 106 to the garment 108.

In the embodiments, the heat conductors 106 comprises a pliant, thermally conductive material. For example the heat conductors 106 may comprise a copper alloy, steel alloy, copper wire, nichrome wire, carbon fibers, ore any suitable pliant, thermally conductive material known in the art. In one exemplary embodiment, the heat conductors 106 comprise known heat pipes.

Referring again to FIGS. 3-5, an end portion 140 of each of the plurality of heat conductors 106 is coupled to the heat manifold 102 for conducting heat from the heat manifold 102 to the garment 108, to warm the garment 108. In one embodiment, the end portion 140 of each conductor 106 extends about an outer surface 142 of the heat manifold 102 and is affixed thereto using known methods. The conductor's end portion 140 may be affixed the heat manifold's outer surface 142 using know methods such as soldering or welding, for example. The conductor's end portion 140 may be affixed the heat manifold's outer surface 142 using any know method that provides a secure connection between the manifold 102 and heat conductors 106, and that does not inhibit heat conduction from the manifold 102 to the heat conductors 106.

As shown in FIG. 4, the end portion 140 of a heat conductor 106 extends about the outer surface 142 of the heat manifold 102 in a generally spiral pattern. In a preferred embodiment, the end portions 140 of the heat conductors 106 are configured to extend about the outer surface 142 of the heat manifold 102, such as in the generally spiral pattern, to maximize contact surface area between the heat conductors' end portions 140 and the heat manifold's outer surface 142, to provide maximum heat transfer from the heat source 104 to the heat conductors 106, and thus to the garment 108.

Referring to FIG. 1 and FIG. 2, the heat conductors 106 are affixed to the garment 108 using known methods. For example, the heat conductors 106 are affixed to the garment 108 using known sewing techniques, known fabric glues, or using any devices and methods known in the art. The heat conductors 106 may also be interleaved between adjacent layers of the fabric comprising the garment 108. In one embodiment, the heat conductors 106 are affixed an inner layer 144 of the garment 108, with an outer layer 146 extending over the heat conductors 106. The heat conductors 106 may be sewn to the inner layer 144 or outer layer 146 using thread 148.

As explained above, embodiments of the invention comprise a thermal distribution and regulation system for a garment. The system includes a self-contained heat source, such as a catalytic heat source. A heat manifold extends about the heat source and is mechanically adjusted relative to the heat source to control the contact surface area between the heat source. Controlling the contact surface area between the heat source and manifold regulates heat conducted from the heat source, through the manifold, and to the heat conductors. The heat manifold is configured with detents that engage protuberances of the heat source at more than one location to prevent inadvertent movement between the heat source and manifold. Adjusting the heat manifold along the heat source functions as a mechanical thermostat for regulating the heat conducted from the heat source to the manifold. The system also includes a plurality of heat conductors coupled to the heat manifold and affixed to the garment. An end of each of the plurality of heat conductors is coupled to the heat manifold for conducting heat from the heat manifold to the garment, to warm the garment.

Those skilled in the art will appreciate that various adaptations and modifications can be configured without departing from the scope and spirit of the embodiments described herein. Therefore, it is to be understood that, within the scope of the appended claims, the embodiments of the invention may be practiced other than as specifically described herein.

What is claimed is:

1. A thermal distribution and regulation device for a garment comprising:

a self-contained heat source;

a heat manifold into which the heat source is insertable and contacting a surface of the heat source, the heat manifold mechanically adjusted relative to the heat source to control the contact surface area between the heat source and the heat manifold for regulating heat conducted from the heat source; and a heat conductor in thermal communication with the heat manifold via being wrapped multiple times, the heat conductor conducting heat from the heat manifold along the garment, wherein the heat source is extended into the heat manifold in a given direction to control the contact surface area between the heat source and the heat manifold, a greater extent to which the heat source is extended into the heat manifold corresponding to a greater amount of the heat conducted from the heat source, wherein the heat manifold has an interior opening having a cross-sectional shape, and the heat source has an exterior cross-sectional shape corresponding to the cross-sectional shape of the interior opening of the heat manifold to permit the heat sources to slidably and directly be insertable into the heat manifold, the exterior cross-sectional shape located a widest potion of the heat source in a direction perpendicular to the given direction, wherein the heat source has a plurality of detents along a length of an exterior of the heat source, and the heat manifold has a plurality of grooves along a length of an interior of the heat source that corresponds to the detents, the detents engageable into different of the grooves so that the heat source is lockably extended into the heat manifold at corresponding different positions of extension, wherein the heat conductor is affixed to the heat manifold and a layer of the garment such that the heat is conducted from the heat source through the heat manifold to heat the garment, wherein the heat conductive is wrapped multiple times around the manifold.

2. The device of claim 1, wherein the heat source comprises one of a chemical, liquid, and catalytic heat source.

3. The device of claim 1, wherein the heat conductor comprises a thermally conductive and pliant material.

4. A thermal distribution and regulation device for a garment comprising:

a self-contained heat source;

a heat manifold into which the heat source is insertable in a given direction and extending about a surface of the heat source and engaging the surface, the heat manifold mechanically adjusted relative to the heat source to control the contact surface area between the heat source and the heat manifold for regulating heat conducted from the heat source; and more than one heat conductor in thermo-mechanical communication with the heat manifold via being wrapped around the heat manifold a plurality of times, and extending along the garment for warming the garment, wherein each of the more than one heat conductors is affixed to a layer of the garment, wherein the heat source is extended into the heat manifold to control the contact surface area between the heat source and the heat manifold, a greater extent to which the heat source is extended into the heat manifold corresponding to a greater amount of the heat conducted from the heat source, wherein the heat manifold has an interior opening having a cross-sectional shape, and the heat source has an exterior cross-sectional shape corresponding to the cross-sectional shape of the interior opening of the heat manifold to permit the heat sources to slidably and directly be insertable into the heat manifold, the exterior cross-sectional shape located a widest potion of the heat source in a direction perpendicular to the given direction, wherein the heat source has a plurality of detents along a length of an exterior of the heat source, and the heat manifold has a plurality of grooves along a length of an interior of the heat source that corresponds to the detents, the detents engageable into different of the grooves so that the heat source is lockably extended into the heat manifold at corresponding different positions of extension.

5. The system of claim 4, wherein the heat source comprises one of a chemical, liquid, and catalytic heat source.

6. The system of claim 4, wherein an end of each of the more than one heat conductor is coupled to the heat manifold such that heat is conducted from the heat source through the heat manifold and along the length of each of the more than one heat conductor for warming the garment.

7. The system of claim 4, wherein each of the more than one heat conductor comprises a flexible, thermally conductive material.

8. A thermal distribution and regulation device for a garment comprising:

a self-contained heat source comprising one of a chemical, liquid, and catalytic heat source;

a heat manifold into which the heat source is insertable in a given direction and extending about a surface of the heat source, the heat manifold mechanically adjusted relative to the surface of the heat source to control the contact surface area between the heat source and the heat manifold to regulate heat conducted from the heat source, the heat manifold configured to engage the surface of the heat source at more than one predetermined location to prevent inadvertent movement between the heat source and the heat manifold to control heat conducted from the heat source to the heat manifold; and a plurality of heat conductors coupled to the heat manifold via being wrapped around the heat manifold a plurality of times, and affixed to the garment, an end of each of the plurality of heat conductors coupled to the heat manifold for conducting heat from the heat manifold to the garment to warm the garment, wherein each of the plurality of heat conductors is affixed to a layer of the garment, wherein the heat source is extended into the heat manifold to control the contact surface area between the heat source and the heat manifold, a greater extent to which the heat source is extended into the heat manifold corresponding to a greater amount of heat conducted from the heat source, wherein the heat manifold has an interior opening having a cross-sectional shape, and the heat source has an exterior cross-sectional shape corresponding to the cross-sectional shape of the interior opening of the heat manifold to permit the heat source to slidably and directly be insertable into the heat manifold, the exterior cross-sectional shape located at a widest portion of the heat source in a direction perpendicular to the given direction, wherein the heat source has a plurality of detents along a length of an exterior of the heat source, and the heat manifold has a plurality of grooves along a length of an interior of the heat source that correspond to the detents, the detents engageable into different of the grooves so that the heat source is lockably extended into the heat manifold at corresponding different positions of extension.

9. The system of claim 8, wherein the self-contained heat source comprises a replenishable heat source.

10. The system of claim 8, wherein the heat manifold is formed complementary to the surface of the heat source.

11. The system of claim 8, wherein a substantial portion of the length of each of the plurality of heat conductors extends about the heat manifold to provide substantial contact area between the heat manifold and each of the plurality of heat conductors to conduct heat along a length of each of the plurality of heat conductors for warming the garment.

12. The system of claim 8, further comprising:

the garment comprising a garment fabricated with more than one layer; and each of the plurality of heat conductors affixed to a layer of the garment and interposed between adjacent layers of the garment.

13. The system of claim 8, wherein each of the plurality of heat conductors comprises a pliant, thermally conductive material.

14. The device of claim 1, wherein the heat conductor is wrapped in a spiral around the heat manifold.

15. The device of claim 14, wherein the heat conductor is wrapped in the spiral around the heat manifold such that for a pair of oppositely positioned detents of the heat source, the heat conductor is positioned above and adjacent to a first detent of the pair and is positioned below and adjacent to a second detent of the pair.

* * * * *